US006364001B1

(12) United States Patent
Cross

(10) Patent No.: US 6,364,001 B1
(45) Date of Patent: Apr. 2, 2002

(54) METHOD OF CASTING AN ARTICLE

(75) Inventor: Andrew Michael Cross, Willoughby, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 0 days.

(21) Appl. No.: 09/639,363

(22) Filed: Aug. 15, 2000

(51) Int. Cl.[7] ..... B22C 9/04
(52) U.S. Cl. ..... 164/516; 164/122.1; 164/35
(58) Field of Search ..... 164/122.1, 122.2, 164/516, 517, 518, 519, 35, 45

(56) References Cited

U.S. PATENT DOCUMENTS 944,254 A 12/1909 Binford
5,465,780 A * 11/1995 Muntner et al. ..... 164/516

OTHER PUBLICATIONS

Brochure by Automated Production Equipment Corporation (A.P.E.) entitled "Product Catalog" and having a copyright date of 1992.

* cited by examiner

*Primary Examiner*—Kuang Y. Lin
(74) *Attorney, Agent, or Firm*—Tarolli, Sundheim, Covell, Tummino & Szabo L.L.P

(57) ABSTRACT

An article, such as an airfoil, is cast by a lost wax investment casting process. The process includes providing a core having a configuration corresponding to the configuration of a space to be formed in the airfoil. The core is at least partially enclosed with a layer of wax. A portion of the layer of wax is removed from the core. The step of removing a portion of the layer of wax from the core includes heating a tubular member and melting a portion of the wax layer by engaging the wax layer with the heated tubular member. Molten wax is conducted away from the core through the heated tubular member. A mold is formed by at least partially coating the wax layer with mold material which extends across the core at the locations where the melted wax was conducted away from the core. The wax layer is removed to form a mold cavity which is filled with molten metal to cast the airfoil.

15 Claims, 3 Drawing Sheets

METHOD OF CASTING AN ARTICLE

BACKGROUND OF THE INVENTION

The present invention relates to a method of casting an article, such as an airfoil, having an internal space. The article may be formed by a lost wax investment casting process.

Airfoils have previously been cast by providing cores having configurations corresponding to the configuration of passages to be formed in the airfoils. The core is enclosed by wax to form a mold cavity pattern having a configuration corresponding to the configuration of the airfoil. The wax is removed from a portion of the core to form areas, commonly referred to as core prints, where portions of the core are exposed.

To form the core prints, wax has previously been removed by using a scalpel to cut away the wax from the core. Edges of the wax are sealed using a hot needle. The process of removing the wax using a scalpel and sealing the edges of the wax with a hot needle is very labor-intensive. In addition, the delicate ceramic cores may be damaged during cutting away of the wax and sealing of the wax.

Once the core prints have been formed, the pattern is covered with ceramic mold material. The ceramic mold material engages the exposed portion of the core at the core prints. After the ceramic mold material has at least partially set, the wax material is removed by heating the mold. This leaves a mold cavity having a configuration corresponding to the configuration of the airfoil to be cast. The ceramic mold material engages the core to hold the core at the areas where the mold material was previously exposed by removing the wax pattern, for example, at the core prints.

Molten metal is then poured into the mold cavity, the molten metal solidifies to form the airfoil. After the molten metal solidifies, the airfoil is removed from the mold and the core material is removed from inside of the airfoil. This leaves passages inside the airfoil to conduct a flow of cooling fluid. These passages have a configuration which corresponds to the configuration of the core.

SUMMARY OF THE INVENTION

The present invention relates to a new and improved method of casting an article having an internal space by a lost wax casting process. The article may be a metal airfoil with an internal passage.

A core is provided. The core has a configuration corresponding to the space in the article. If the article is an airfoil, the core may have a configuration corresponding to the configuration of a passage in the airfoil. The core is at least partially enclosed with a layer of wax.

A portion of the wax layer is removed from the core. A mold is formed by at least partially coating the wax layer with mold material. The wax layer is removed from the mold to form a mold cavity. The mold cavity is filled with a flowable material, such as molten metal, which engages the core to form the internal space in the cast article.

A portion of the wax layer is removed from the core by heating a tubular member. The heated tubular member engages the wax layer to melt a portion of the wax layer. Melted wax is conducted away from the core through the heated tubular member.

BRIEF DESCRIPTION OF THE DRAWINGS

The foregoing and other features of the invention will become more apparent upon a consideration of the following description taken in connection with the accompanying drawings wherein.

DESCRIPTION OF ONE SPECIFIC PREFERRED EMBODIMENT OF THE INVENTION

Casting Process—General Description

The present invention may be utilized during the formation of many different types of articles. For example, the invention may be utilized during the formation of a metal airfoil 20, which has been schematically illustrated in FIG. 1. The airfoil 20 is formed by a lost wax investment casting process. The airfoil 20 has a known construction and includes a mounting or root end portion 22 and a platform 24. A blade 26 extends outward from the platform 24.

Figure 2:
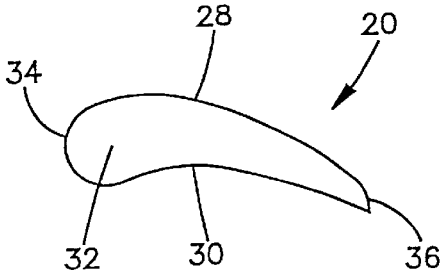
FIG. 2 is an end view, taken generally along the line 2—2 of FIG. 1.

The blade 26 has a convex side surface 28 which faces upward, as viewed in FIG. 2. In addition, the blade 26 has a concave side surface 30 which faces downward, as viewed in FIG. 2. The concave and convex side surfaces 28 and 30 extend from the platform 24 to a tip end portion 32 of the blade 26. The blade 26 has a leading edge portion 34 and a trailing edge portion 36.

The airfoil 20 is intended for use as a blade in a turbine engine. During use, the airfoil is exposed to a very hot environment. Therefore, cooling passages 40 (FIG. 1) may be provided in the airfoil 20. The cooling passages 40 may extend from the root end portion 22 to the tip end portion 32 of the airfoil. The cooling passages 40 may have outlets, indicated schematically at 44 in FIG. 1, along the trailing edge portion 36 of the airfoil.

Figure 1:
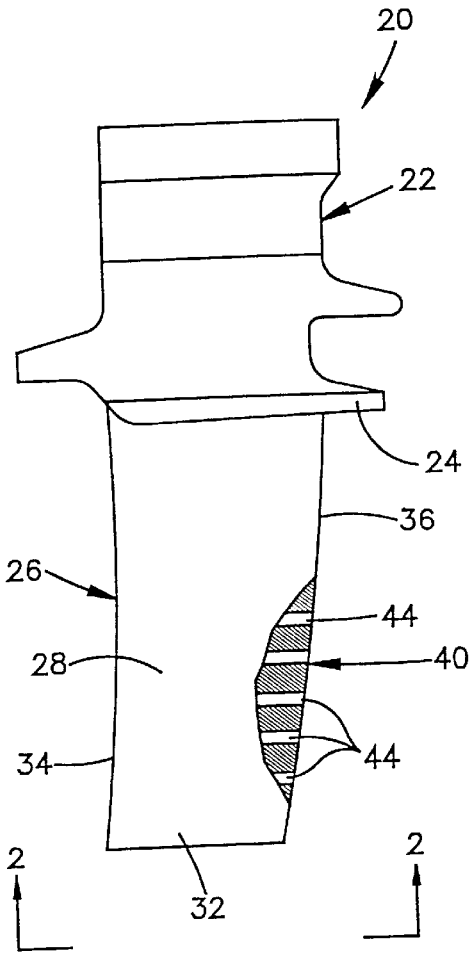
FIG. 1 is a schematic, partially broken away, plan view of a metal article, specifically an airfoil, formed by the method of the present invention.

Although the cooling passages 40 have been illustrated schematically in FIG. 1 in conjunction with only the trailing edge portion 36, it should be understood that there may be a network of cooling passages which extend throughout the blade 26. The cooling passages 40 in the blade 26 may be connected with a source of pressurized cooling fluid. During use of the blade 26 in a turbine engine, cooling fluid is conducted through the passages 40.

The airfoil 20 is formed of a material capable of withstanding severe operating conditions. In one specific instance, the airfoil 20 was formed of a nickel-chrome superalloy. Of course, the airfoil may be formed of other metals if desired. It is contemplated that the airfoil 20 could be formed of a material other than metal. For example, the airfoil 20 could be formed of a suitable ceramic.

The airfoil 20 is intended for use as a blade in a turbine engine. However, the airfoil 20 could extend between shroud rings of a turbine-engine. The airfoil 20 could be oriented relative to the shroud rings in an orientation similar to the orientation disclosed in U.S. Pat. No. 4,464,094 or in U.S. Pat. No. 4,728,258.

When the airfoil 20 is to be cast, a pattern assembly 50 (FIGS. 3 and 4) is formed. The pattern assembly 50 includes a ceramic core 52 which is enclosed by a layer 54 of wax. The wax forming the layer 54 may be either a natural wax or an artificial wax.

The ceramic core 52 has a configuration corresponding to the desired configuration of passages in the airfoil 20. When the layer 54 of wax is to be formed around the core 52, the core 52 is positioned in a pattern mold cavity. The pattern mold cavity has a configuration which corresponds to the desired configuration of the airfoil 20. Wax is injected into the pattern mold cavity to form the layer 54 of wax. A portion of the layer 54 of wax has an outer surface configuration corresponding to the desired surface configuration of the airfoil 20.

The core 52 has an axial extent which is greater than the axial extent of the airfoil 20. Thus, the core 52 has a root end supporting portion 56 with flanges 58 and 60 which engage corresponding recesses in the pattern mold cavity. Although the wax layer 54 has been schematically illustrated as being broken away from the root end supporting portion 56 and flanges 58 and 60 of the core 52, it should be understood that the wax layer 54 encloses the root end supporting portion and flanges of the core 52.

A portion 64 of the layer 54 of wax overlies the root end supporting portion 56 of the core 52 and a portion of the core having configuration corresponding to the configuration of a passage to be formed in the root end portion 22 of the airfoil 20. In addition, the wax layer 54 has a portion 66 overlies a portion of the core 56 having a configuration corresponding to the configuration of a passage in the platform 24 of the airfoil 20.

A portion 70 of the wax layer 54 overlies a portion of the core 52 having a configuration corresponding to the configuration of passages to be formed in the blade 26 of the airfoil 20. The portion of the core 52 corresponding to passages in the blade 26 is an intricate lattice which is connected with the relatively solid supporting portion 56 of the core 52. The portion 70 of the wax layer 54 has a configuration corresponding to the configuration of the blade 26 of the airfoil 20.

The core 52 has a tip end supporting portion 74 which extends axially downward (as viewed in FIG. 3) from the portion of the pattern assembly 50 having a configuration corresponding to the configuration of the airfoil 20. Thus, the portion 70 of the wax layer 54 overlies the portion of the core 52 having a configuration corresponding to the configuration of the blade 26 of the airfoil 20. The portion 76 of the wax layer 54 extends around and encloses the tip end supporting portion 74 of the core 52.

Figure 3:
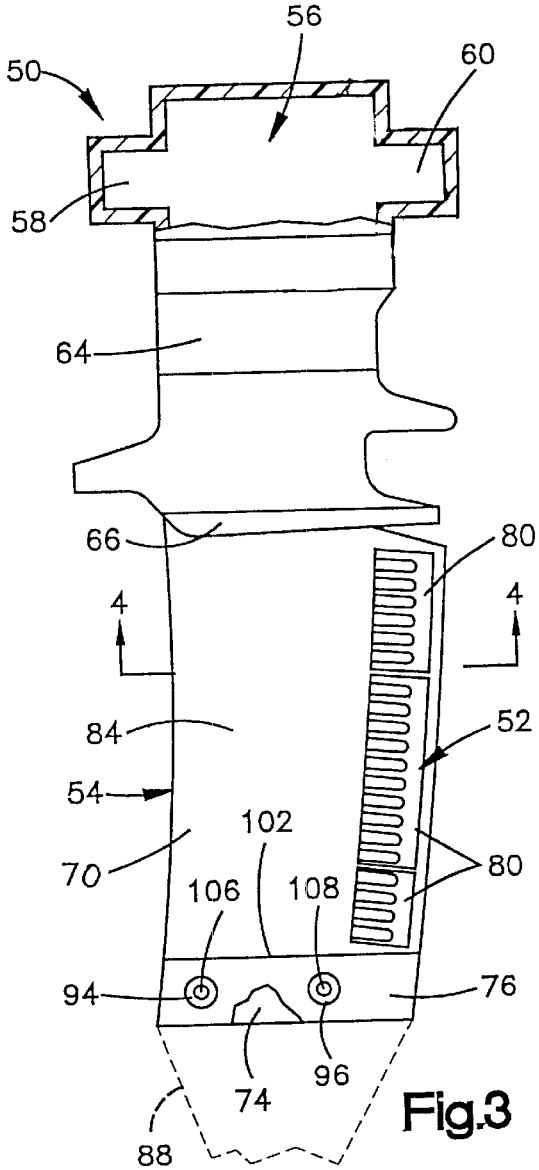
FIG. 3 is a schematic plan view, generally similar to FIG. 1, illustrating a pattern which is used in forming the airfoil of FIG. 1.

In addition to being supported in the mold at the root end supporting portion 56 of the core 52 and at the tip end supporting portion 74, openings or core prints 80 are formed in the wax layer 54. The openings or core prints 80 extend over the portion of the core which extends outward from the portion 70 of the wax layer 54 having a configuration corresponding to the configuration of the blade 26 of the airfoil 20. Although only the core prints 80 on the one side of the pattern 50 are illustrated in FIG. 3, there are corresponding core prints on the opposite side of the pattern 50.

The core 52 extends past the portion of the wax layer 70 which corresponds to the trailing edge 36 of the airfoil. The portions of the core extending into the core prints 80 form the outlets 44 (FIG. 1) for the cooling passages 40 in the airfoil 20.

Figure 4:
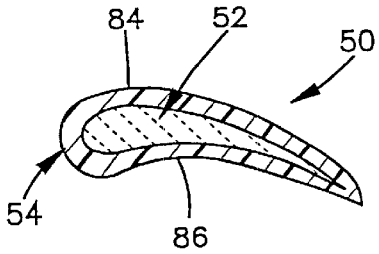
FIG. 4 is a schematic sectional view, taken generally along the line 4—4 of FIG. 3, illustrating the manner in which the pattern is formed by a core and a layer of wax.

The portion of the core 52 enclosed by the portion 70 of the wax layer having a configuration corresponding to the configuration of the blade 26 of the airfoil 20 has a convex side surface 84 and a concave side surface 86 (FIG. 4). The convex and concave side surfaces 84 and 86 of the core 52 have a configuration which is somewhat similar to the configuration of the convex and concave side surfaces 28 and 30 of the airfoil 20 (FIG. 2). However, the concave and convex side surfaces 84 and 86 of the core 52 are discontinuous and are formed by the delicate lattice work structure of the core. In addition, the convex and concave side surfaces 84 and 86 of the core 52 are disposed closer together than are the convex and concave side surfaces 28 and 30 of the airfoil 20.

It is contemplated that the core 52 may have any one of many known configurations and may be constructed in any one of many different known materials. For example, the core 52 may have a construction similar to the construction of the core illustrated in U.S. Pat. No. 5,409,871 and may be formed of the material disclosed in that patent. Alternatively, the core 52 may have a construction similar to the construction of the core illustrated in U.S. Pat. No. 4,596,281.

It should be understood that the present invention is not to be limited to any specific core construction or to any specific construction of the article to be cast, such as the airfoil 20. The core 52 and airfoil 20 have been illustrated schematically in FIGS. 1–4 as being representative of many known cores and articles having many different constructions. The core, itself, may be formed in a manner which is similar to that disclosed in U.S. Pat. No. 4,583,581 when the article to be cast is an airfoil.

Once the pattern assembly 50 has been formed, the pattern assembly is connected with a wax gating pattern. Thus, the upper end portion of the pattern assembly 50 is connected with a pattern having a configuration corresponding to the configuration of a pour cup and runner. The pour cup and runner pattern may be formed of either natural or synthetic wax. A runner of the gating pattern is connected with the portion of the pattern assembly disposed above the upper (as viewed FIG. 3) end of the portion 64 of the layer 54 of wax having a configuration corresponding to the configuration of the root end portion 22 of the airfoil 20.

The lower (as viewed in FIG. 3) end portion of the pattern assembly 50 may be connected with a wax pattern 88 of a single crystal selector. The use of a single crystal selector enables the airfoil 20 to be cast as a single crystal in a known manner. If the airfoil is to have an equiaxed or directionally solidified (columnar grain) crystallographic structure, the single crystal selector may be omitted. A plurality of the pattern assemblies 50 may be disposed in a circular array and connected with a circular gating pattern. Alternatively, only a single pattern assembly 50 could be connected with the gating pattern to enable only a single airfoil 20 to be cast.

Once a pattern assembly 50 having a desired configuration has been formed, a wet coating of ceramic mold material is applied over the pattern assembly. The wet coating of ceramic mold material may be applied over the pattern assembly by dipping, brushing, spraying or other methods. However, it is believed that it may be preferred to repetitively dip the pattern 50 in a liquid slurry of ceramic mold material. Although many different types of slurry could be utilized, one illustrative slurry contains fused silica, zircon, or other refractory materials in combination with binders. If desired, the slurry could have a composition similar to that disclosed in U.S. Pat. No. 4,947,927.

After a slurry coating of a desired thickness has been applied to the pattern assembly 50, the coating is partially dried. The wax material of the pattern assembly 50, including the layer 54 of wax enclosing the core 52, is then melted and removed from the resulting mold. After de-waxing, waxing, the uncured mold is fired in an oxidizing atmosphere to thoroughly cure the mold.

When the airfoil 20 is to be cast as a single crystal, the mold may be similar to the molds disclosed in U.S. Pat. Nos. 5,062,468 and 5,062,469. Alternatively, the mold could be constructed in a manner similar to that disclosed in U.S. Pat. No. 4,862,947.

A flowable material, specifically a molten nickel-chrome superalloy metal, is poured into the mold. The molten metal solidifies to form the airfoil 20. The exterior surfaces of the airfoil 20 are shaped by interior surfaces of the mold cavity in the mold. The molten metal solidifies around the core 52. It should be understood that the airfoil 20 or other article could be cast of a flowable material other than molten metal.

After the molten metal has solidified, the airfoil 20 is removed from the mold. When the airfoil is removed from the mold, the core 52 is still enclosed by the solidified metal of the airfoil. The core 52 is subsequently removed from the metal of the airfoil. This may be done by a leaching process or other known methods.

The foregoing lost wax investment casting process can be utilized to form many articles other than metal airfoils. Thus, the process can be utilized to form articles which are not metal. The process can be utilized to form articles which are not airfoils.

Removal of Wax

In accordance with one of the features of the present invention, a portion of the wax layer 54 (FIG. 3) is removed to expose surface areas on the core 52. Removal of a portion of the layer 54 of wax enables the mold material to be adjacent the core 52 after dipping of the pattern assembly 50 in a slurry of a mold material. When the mold material solidifies and is de-waxed, the mold material engages the core 52 to hold the core in a desired position in the mold cavity.

The areas of the pattern assembly 50 from which wax of the layer 54 is removed to expose portions of the core may be disposed on portions of the pattern assembly which do not correspond to portions of the airfoil 20. For example, areas 94 and 96 (FIG. 3) of the core 52 are exposed by removing relatively small portions of the wax layer 54 overlying the tip end supporting portion 74 of the core 52.

The tip end supporting portion 74 of the core 52 is disposed below (as viewed in FIG. 3) a line 102 corresponding to the tip end portion 32 (FIG. 1) of the airfoil 20. Therefore, the metal of the as-cast airfoil 20 is removed below (as viewed in FIG. 3) the line 102 on the pattern assembly 50 to form the tip end portion 32 (FIG. 1) of the airfoil 20. Thus, portions of the layer 54 of wax are removed from areas on the pattern assembly 50 which correspond to metal which is cut away from the as-cast airfoil during finishing of the airfoil 20. Although only a pair of areas 94 and 96 on a convex side of the core 52 are shown as being exposed in FIG. 3, it should be understood that areas on a concave side of the core 52 are exposed on the opposite side of the pattern assembly 50 from the areas 94 and 96.

When the pattern assembly 50 is coated with mold material, the mold material extends into the areas 94 and 96 where the layer of wax was removed. The mold material also extends into areas (not shown) on the side of the core 52 opposite from the areas 94 and 96 where the wax layer 54 was removed from the core. The core prints 80 may be formed on opposite sides of the core 52 during injection molding of the wax layer 54. Alternatively, the core prints 80 may be formed on opposite sides of the core 52 by removing portions of the wax layer 54 after injection molding of the wax layer.

During casting of the molten metal, the mold material engages the portions of the core at the areas 94 and 96 and corresponding portions on the opposite side of the core to hold the core in a desired position relative to the airfoil mold cavity. A pair of circular projections or protuberances 106 and 108 are formed on the core 52 at the centers of the areas 94 and 96 where material of the wax layers 54 was removed. The projections 106 and 108 engage the ceramic mold material to hold the core 52 against movement relative to the mold. Small indentations or dimples may be formed in the core at the areas where the wax was removed on the opposite side of the pattern assembly 50 to further promote anchoring of the core in the mold.

Although the areas 94 and 96 where portions of the wax layer 54 were removed have been illustrated in FIG. 3 as being disposed on the tip end supporting portion of the core 52, portions of the wax layer 54 could be removed from other locations on the assembly 50. For example, areas of the wax layer 54 overlying the root end supporting portion 56 of the core 52 could be removed. Thus, small areas, of a configuration corresponding to the configuration of the areas 94 and 96, of the core 52 would be exposed through the layer 54 of wax on opposite sides of the root end supporting portion 56 of the core. If desired, areas of wax could be removed from the portion of the layer 54 of wax overlying the flanges 58 and 60 of the core 52.

It should be understood that areas of the wax layer 54 could be removed from any desired location on the pattern assembly 50. It is believed that it may be preferred to remove portions of the wax layer 54 which do not correspond to portions of the airfoil 20 in order to simplify finishing of the airfoil. Although only relatively small areas 94 and 96 of the core 52 are illustrated as being exposed in FIG. 3, it is contemplated that a larger area of the core could be exposed if desired or that areas of the core having different configurations could be exposed if desired.

In accordance with another feature of the present invention, an apparatus 120 (FIG. 5) is provided to remove portions of the wax layer 54. The apparatus 120 includes a hand-held stylus 122. The stylus 122 has a cylindrical intake tube 124 which is connected with a source of suction 126 by a conduit or flexible tube 130.

An electrically energized heater element 134 extends around the intake tube 124. The heater element 134 is connected with a source of electrical energy by an electrical cord or conductor 136. The heater element 134 is effective to heat the intake tube 124.

Figure 5:
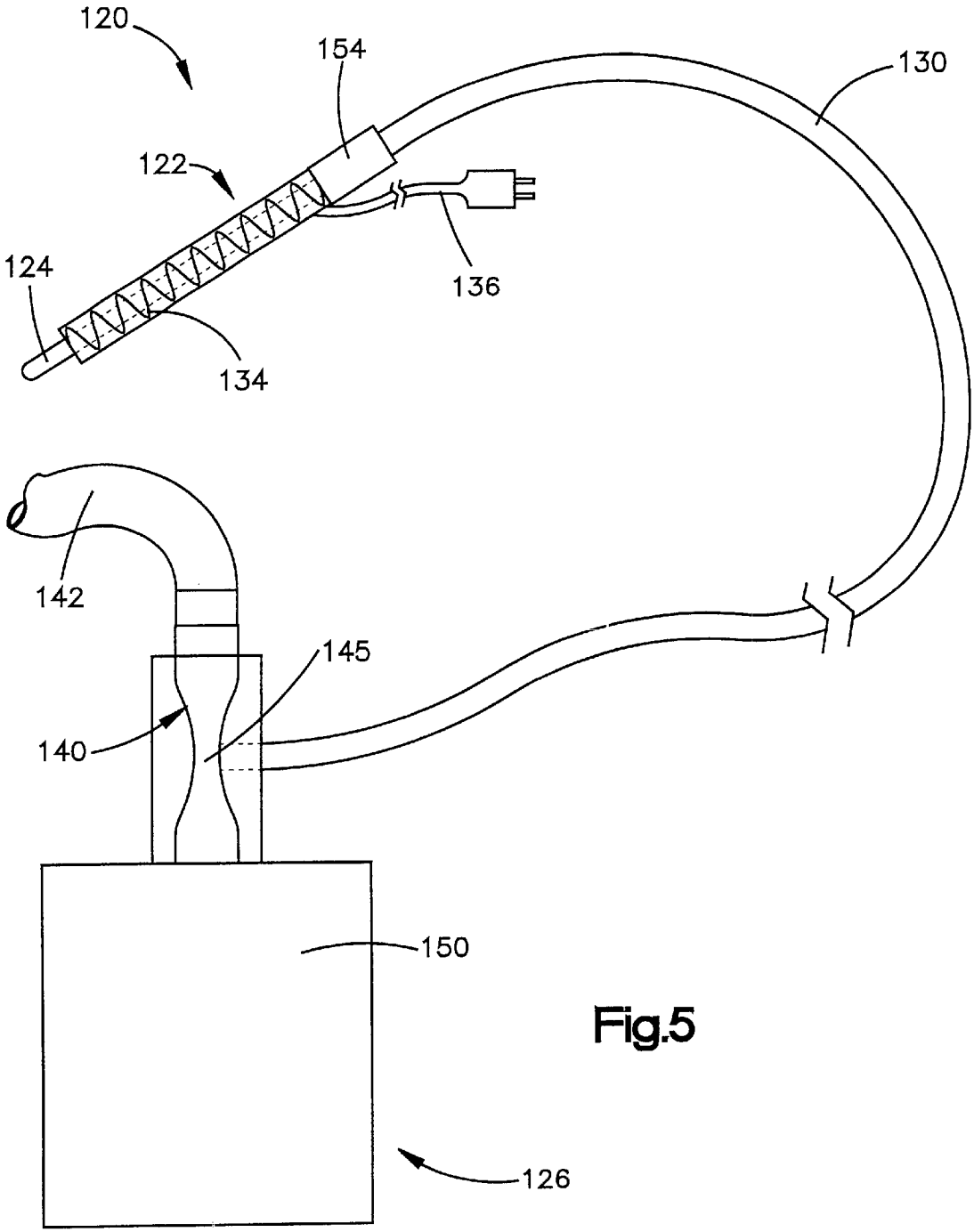
FIG. 5 is a schematic illustration of an apparatus which is utilized to remove portions of the wax layer from the core.

The source of suction 126 is illustrated schematically in FIG. 5. The source of suction 126 includes a venturi 140 which is connected with a source of fluid (air) under pressure by a conduit 142. The venturi 140 converges to a throat 146 and the en diverges from the throat. The conduit 130 is connected with the throat 146 of the venturi 140. Fluid (air) which is conducted from the conduit 142 through the venturi 140 enters a collector 150. The collector 150 is vented to atmosphere.

During use of the apparatus 120 fluid (air) under pressure is conducted through the venturi 140 into the collector 150. The resulting low pressure at the throat 146 of the venturi reduces the fluid pressure in the conduit 130. Since the conduit 130 is connected with the intake tube 124, air is drawn into the intake tube and flows through the conduit to the source of suction 126.

When the apparatus 120 is being used to remove wax from the layer 54, the heater element 134 heats the intake tube 124. The hot intake tube 124 is moved into engagement with the wax at a location where the wax is to be removed. Since the heater element 134 extends around and is moved with the intake tube 124, the intake tube remains hot as it is moved relative to the wax layer 54.

The hot intake tube 124 is effective to melt wax of the layer 54 as the intake tube and heater element 134 are moved together relative to the pattern assembly 50. The suction in the conduit 130 causes the wax to pass through the intake tube 124 into the filter unit 154. The filter unit 154 is connected with the conduit 130. The large majority of the melted wax in the flow of air and wax through the intake tube 124 is removed at the filter unit 154. The flow of air, with very minute particles of wax therein, flows from the filter unit 154 through the conduit 130 into the collector 150.

Although the apparatus 120 has been illustrated schematically in FIG. 5, it is contemplated that the apparatus may have a construction similar to the construction of a model EX680, digital desoldering system which is commercially available from Automated Production Equipment Corp. (A.P.E.) having offices at 142 Peconic Avenue, Medford, N.Y. 11763. Of course, the apparatus 120 could have a different construction if desired. It is not intended to limit the invention to any specific construction of the apparatus 120.

The filter unit 154 may have a layer of metal fiber, that is, steel wool, which engages the hot wax as it flows from the intake tube 124 to the conduit 130. A body of felt fiber is provided immediately downstream from the metal fiber to remove wax which does not adhere to the metal fiber. If desired, a baffle may be provided upstream from the metal fiber to cause the air with wax entrained therein to flow along a serpentine course which promotes depositing of larger particles of wax before it reaches the steel wool. It should be understood that the filter unit 154 could have a construction which is different than this specific construction.

Method of Use of Wax Removal Apparatus

When the wax removal apparatus 120 is to be utilized during the formation of the airfoil 20, the core 52 is enclosed by a layer 54 of wax to form the pattern assembly 50 (FIGS. 3 and 4) in the manner previously explained. At selected locations where portions of the wax layer 54 are to be removed, for example, at the areas 94 and 96 of FIG. 3, the wax removal apparatus 120 is utilized to melt the wax and move the melted wax away from the core 52.

Figure 6:
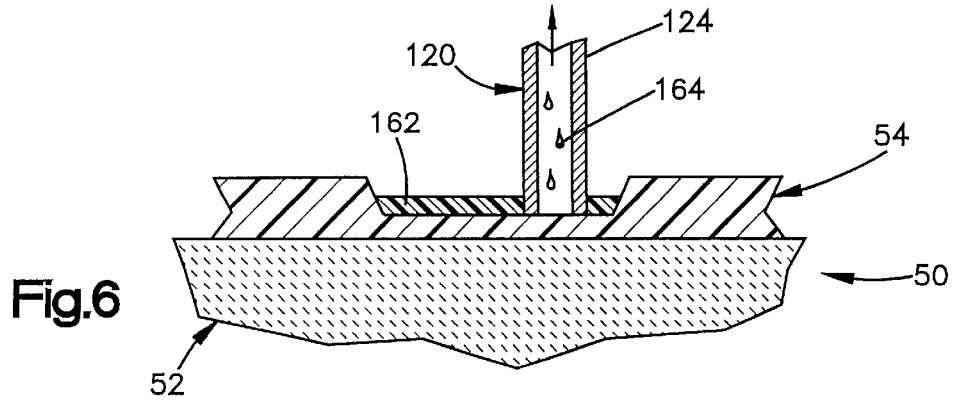
FIG. 6 is a schematic fragmentary illustration depicting the manner in which a heated tubular member forming part of the apparatus of FIG. 5 engages wax forming part of the pattern of FIGS. 3 and 4 to melt the wax.

After the heater element 134 (FIG. 5) has heated the intake tube 124 to a temperature of approximately 345° F., the intake tube is moved into engagement with the wax layer 54 in the manner illustrated schematically in FIG. 6.

It should be understood that the heater element 134 moves with intake tube 124. This enables the heater element 134 to maintain the intake tube 124 at a desired temperature during engagement of the intake tube with the layer 54 of wax.

When the hot metal intake tube 124 engages the material of the wax layer 54, the wax is melted in the manner indicated schematically at 162 in FIG. 6. Droplets 164 of wax are drawn through the intake tube 124 to the filter unit 154 (FIG. 5) by suction conducted through the conduit 130 to the filter unit 154 and intake tube 124.

Figure 7:
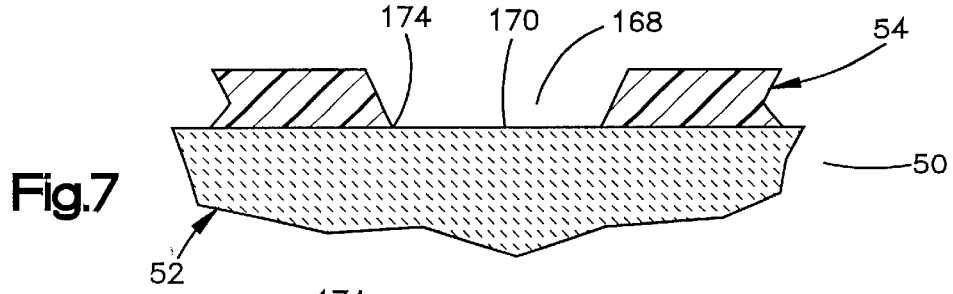
FIG. 7 is a fragmentary schematic illustration, generally similar to FIG. 6, illustrating the relationship between the layer of wax and the core after a portion of the layer of wax has been melted and conducted through the tubular member of FIG. 6.

The intake tube 124 is manually moved relative to the core 52 to melt wax in an area where an opening 168 (FIG. 7) is to be formed in the wax layer to expose a surface area 170 on the core 52. The exposed surface area 170 may have a circular configuration corresponding to the circular configuration of the area 94 (FIG. 3) or an oval configuration. Of course, the opening 168 could have any desired configuration. For example, the opening 168 could have a generally polygonal configuration.

As the opening 168 is formed to expose the surface area 170 of the core 52, a joint 174 (FIG. 7) between the layer 54 of wax and the core 52 is sealed by the melted wax 162 (FIG. 6). Although the exposed surface area 170 of the core 52 has been illustrated in FIG. 7 as having substantially flat configuration, it is contemplated that one or more projections, corresponding to the projections 106 and 108 of FIG. 3, could be provided on the core 52.

Figure 8:
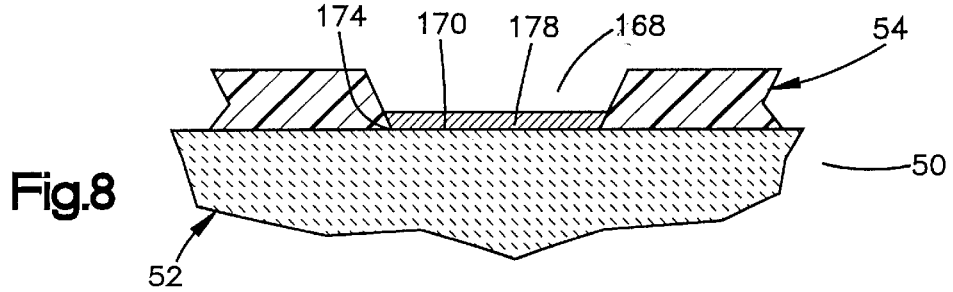
FIG. 8 is a schematic illustration depicting the manner in which a thin layer of material is positioned over an exposed portion of the core.

Once the wax has been removed to form the opening 168 and expose the surface area 170 (FIG. 7) of the core, a thin layer 178 (FIG. 8) of material may be placed over the exposed surface area 170 of the core 52. The thin layer 178 of material may be in the form of a tape. Alternatively, the thin layer 178 of material be formed by a liquid which dries to form a solid, such as nail polish. The thin layer 178 of material is provided to accommodate differences in the coefficient of thermal expansion of the core 52 and the material of the mold which encloses the core during casting of the airfoil 20.

Once the thin layer 178 of material has been applied over the exposed surface area 170 at the opening 168 (FIG. 8), the pattern assembly 50 is covered with a coating of ceramic mold material. As was previously mentioned, the coating of ceramic mold material may be applied by repetitively dipping the pattern assembly 50 in a body of ceramic mold material.

Figure 9:
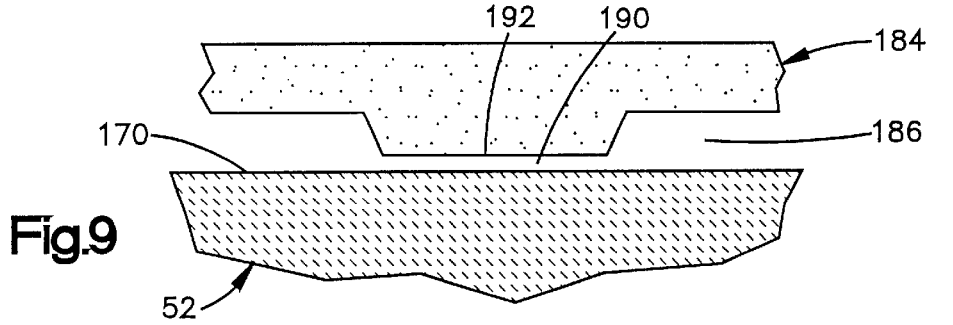
FIG. 9 is a fragmentary schematic illustration, generally similar to FIGS. 6–8, illustrating the relationship between the core and a mold.

Once the pattern assembly 50 has been enclosed by the ceramic mold material, the ceramic mold material is dried and then fired to form a mold 184 (FIG. 9). During firing, the thin layer 178 of material is removed from the core 52. The mold 184 has an article mold cavity 186 with a configuration which corresponds to the configuration of the layer 54 of wax. Therefore, a portion of the article mold cavity 186 has a configuration which corresponds to the configuration of the airfoil 20.

The core 52 is disposed in the mold cavity 186 (FIG. 9). The thin layer 178 (FIG. 8) of material which was placed over the surface area 170 on the core 52 at the opening 168 is removed to form a thin space 190 (FIG. 9) a between the surface 170 of the core 54 and a surface area 192 on the mold 84. The space 190 between the core 52 and mold 184 enables relative movement to occur between the mold 184 and core 52 to an extent sufficient to accommodate differences in thermal expansion of the mold 184 and core 52 during heating of the mold and casting of the airfoil 20.

It should be understood that the space 190 is relatively small and is eliminated during heating of the mold 184 and core 52 prior to pouring of molten metal or other flowable material into the mold cavity 186. Therefore, when the molten metal is poured into the mold cavity 186, the core 52 engages the mold 184 and is held in a desired position relative to the mold. Thus, the surface 192 on the mold 184 engages the surface 170 on the core 54 to hold the core against movement as molten metal is poured into the mold cavity 186.

Figure 10:
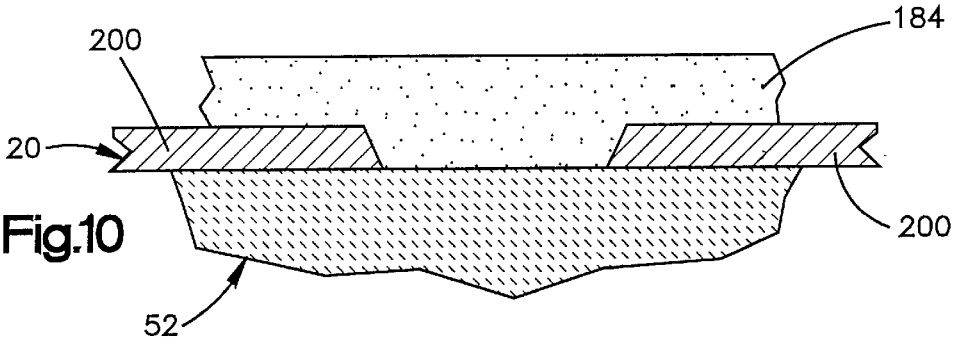
FIG. 10 is a schematic illustration, generally similar to FIGS. 6–9, illustrating the relationship between the mold and the core after molten metal has been poured in the mold to form a cast article, that is, the airfoil of FIG. 1.

The molten metal which is poured into the mod cavity 186 forms a layer 200 (FIG. 10) which encloses the core 52. The layer 200 of molten metal is solidified to form the airfoil 20. Once the layer of molten metal solidifies, the cast metal airfoil 20 is removed from the mold 184. The core 52 is then removed from the cast metal airfoil by leaching or other known processes.

Removal of the core 52 from the airfoil 20 results in the formation of passages in the airfoil 20. These passages have a configuration corresponding to the configuration of the core. During subsequent finishing of the airfoil 20, the excess metal which overlies the root end supporting portion 56 (FIG. 3) of the core 52 is removed. In addition, the excess metal overlying the tip end supporting portion 74 of the core 52 is also removed. The trailing edge portion 36 of the airfoil is formed by cutting away excess metal and the portion of the core adjacent to the core print openings 80 of FIG. 3.

In the foregoing description, the wax removal apparatus 120 was utilized to remove relatively small areas 94 and 96 of the wax layer 54 to expose the surface area 170 of the core 52. It is contemplated that the wax removal apparatus 120 could be utilized to form relatively large openings, such as the core print openings 80 (FIG. 3) in the pattern assembly 50. Of course, the wax removal apparatus 120 could be utilized to form openings having any desired configuration at any desired location in the wax pattern assembly 50.

The foregoing description has related to the formation of one specific cast article, that is, the airfoil 20. Although it is believed that it will be particularly advantageous to form the airfoil 20 with the present invention, the invention may be used during the formation of many different types of metal articles by a lost wax investment casting process.

Conclusion

The present invention relates to a new and improved method of casting an article 20 having an internal space 40 by a lost wax casting process. The article may be a metal airfoil 20 with an internal passage 40.

A core 52 is provided. The core 52 has a configuration corresponding to the space 40 in the article. If the article is the airfoil 20, the core may have a configuration corresponding to the configuration of the passage 40 in the airfoil. The core 52 is at least partially enclosed with a layer 54 of wax.

A portion of the wax layer 54 is removed from the core 52. A mold 186 is formed by at least partially coating the wax layer 54 with mold material. The wax layer 54 is removed from the mold to form a mold cavity 186. The mold cavity 186 is filled with molten metal 200 or other flowable material, which engages the core 52 to form the internal space 40 in the cast article.

A portion of the wax layer 54 is removed from the core 52 by heating a tubular member 124. The heated tubular member 124 engages the wax layer 54 to melt a portion of the wax layer. Melted wax is conducted away from the core 52 through the heated tubular member 124.

From the above description of the invention, those skilled in the art will perceive improvements, changes and modifications. Such improvements, changes and modifications within the skill of the art are intended to be covered by the appended claims.

Having described the invention, the following is claimed:

1. A method of forming a cast metal airfoil having an internal passage, said method comprising the steps of providing a core having a portion with a configuration which corresponds to the configuration of at least a portion of the passage, at least partially enclosing the core with a layer of wax, removing a portion of the wax layer from the core, said step of removing a portion of the wax layer from the core includes heating a tubular member, melting a portion of the wax layer by engaging the wax layer with the heated tubular member, and conducting melted wax away from the core through the heated tubular member, forming a mold by at least partially coating the wax layer with mold material which extends across the core where the melted wax was conducted away from the core, thereafter, removing the wax layer from the mold to form an airfoil mold cavity, filling the airfoil mold cavity with molten metal, engaging the core with the mold material during filling of the airfoil mold cavity with molten metal, and solidifying the molten metal in the airfoil mold cavity to form the cast metal airfoil.

2. A method as set forth in claim 1 wherein the core has a portion with a configuration corresponding to the configuration of passages to be formed in a trailing edge portion of the airfoil, said step of removing a portion of the wax layer from the core includes removing a portion of the wax layer adjacent to the portion of the core which has a configuration corresponding to the configuration of the passages in the trailing edge portion of the airfoil.

3. A method as set forth in claim 1 wherein the core has a portion with a configuration which corresponds to the configuration of the passage to be formed in a tip end portion of the airfoil, said step of removing a portion of the wax layer from the core includes removing a portion of the wax layer adjacent to the portion of the core which has a configuration corresponding to the configuration of the passage to be formed in the tip end portion of the airfoil.

4. A method as set forth in claim 1 wherein the core has a portion with a configuration which corresponds to the configuration of a passage to be formed in a root end portion of the airfoil, said step of removing a portion of the wax layer from the core includes removing a portion of the wax layer adjacent to the portion of the core which has a configuration corresponding to the configuration of the passage to be formed in the root end portion of the airfoil.

5. A method as set forth in claim 1 wherein the core has a first side with a convex configuration and a second side with a concave configuration, said step of removing a portion of the wax layer from the core includes removing a portion of the wax layer at a first location adjacent to the first side of the core and removing a portion of the wax layer at a second location adjacent to the second side of the core, said step of engaging the core with the mold material during filling of the airfoil mold cavity with molten metal includes engaging the core at the first and second locations with the mold material.

6. A method as set forth in claim 1 wherein said step of removing a portion of the wax layer from the core includes removing a portion of the wax layer from opposite sides of the core, said step of engaging the core with mold material includes engaging the core with the mold material at the locations on opposite sides of the core where portions of the wax layer were removed.

7. A method as set forth in claim 1 wherein said step of removing a portion of the wax layer from the core includes exposing material of the core through the wax layer, said step of engaging the core with the mold material during filling of the airfoil mold cavity with the molten metal includes engaging the core with the mold material at a location where material of the core was exposed through the wax layer.

8. A method as set forth in claim 1 wherein said step of removing a portion of the wax layer from the core includes exposing material of the core through the wax layer, said method further includes placing a thin layer of material over the exposed material of the core, said step of at least partially coating the wax layer with mold material includes engaging the thin layer of material placed over the exposed material of the core with the mold material, said method further includes removing the thin layer of material placed over the exposed material of the core after performance of said step of at least partially coating the wax layer with mold material.

9. A method as set forth in claim 1 wherein said step of heating a tubular member includes energizing an electrical heater element connected with the tubular member, said step of melting a portion of the wax layer with the heated tubular member includes moving the electrical heater element and heated tubular member together relative to the core.

10. A method as set forth in claim 1 wherein said step of conducting melted wax away from the core through the heated tubular member includes conducting a flow of fluid along a flow path which converges and then diverges in a direction of fluid flow, conducting a flow of air from an open end portion of the tubular member towards the flow of fluid, and moving melted wax away from the open end portion of the tubular member under the influence of the flow of air.

11. A method of forming a cast article, said method comprising the steps of providing a core, at least partially enclosing the core with a layer of wax, removing a portion of the wax layer from opposite sides of the core to expose material of the core through the wax, layer at locations disposed on opposite sides of the core, said step of removing a portion of the wax layer from opposite sides of the core includes heating a tubular member, melting a portion of the wax layer by engaging a portion of the wax layer with the heated tubular member, and conducting melted wax away from the core through the heated tubular member, forming a mold by at least partially coating the wax layer with mold material which extends across the portions of the core where the portions of the wax layer were removed, thereafter, removing the wax layer from the mold to form a mold cavity, filling the mold cavity with a flowable material, and solidifying the flowable material in the mold cavity to form the cast article.

12. A method as set forth in claim 11 further including the steps of placing a thin layer of material over the exposed material of the core at the locations disposed on opposite sides of the core where the wax layer was removed, said step of coating the wax layer with mold material includes engaging the thin layer of material placed over the exposed material of the core with the mold material, said method further includes removing the thin layer of material placed over the exposed material of the core after performance of said step of at least partially coating the wax layer with the mold material.

13. A method as set forth in claim 11 wherein said step of heating a tubular member includes energizing an electrical heater element connected with the tubular member, said step of melting a portion of the wax layer with the heated tubular member includes moving the electrical heater element and heated tubular member together relative to the core.

14. A method as set forth in claim 11 wherein said step of conducting melted wax away from the core through the heated tubular member includes conducting a flow of fluid along a flow path which converges and then diverges in a direction of fluid flow, conducting a flow of air from an open end portion of the tubular member towards the flow of fluid, and moving melted wax away from the open-end portion of the tubular member under the influence of the flow of air.

15. A method of forming a cast airfoil having a concave side, a convex side, and an internal passage, said method comprising the steps of providing a core having a portion with a concave side, a convex side, and a configuration which corresponds to the configuration of at least a portion of the passage in the airfoil, at least partially enclosing the concave and convex sides of the core with a layer of wax, removing portions of the wax layer from the concave and convex sides of the core to expose material of the core through the wax layer, said step of removing portions of the wax layer from the concave and convex sides of the core includes heating a tubular member, melting a portion of the wax layer on the concave side of the core by engaging a portion of the wax layer on the concave side of the core with the heated tubular member, melting a portion of the wax layer on the convex side of the core by engaging a portion of the wax layer on the convex side of the core with the heated tubular member, and conducting melted wax away from the core through the heated tubular member, forming a mold by at least partially coating the wax layer with mold material which extends across the concave and convex sides of the core where the portions of the wax layer were removed, thereafter, removing the wax layer from the mold to form an airfoil mold cavity, filling the airfoil mold cavity with flowable material, and solidifying the flowable material in the airfoil mold cavity to form the cast airfoil.

* * * * *

UNITED STATES PATENT AND TRADEMARK OFFICE

CERTIFICATE OF CORRECTION

PATENT NO. : 6,364,001 B1
DATED : April 2, 2002
INVENTOR(S) : Cross

It is certified that error appears in the above-identified patent and that said Letters Patent is hereby corrected as shown below:

Title page,
Item [*] Notice, delete the phrase “by 0 days” and insert -- by 5 days --

Signed and Sealed this

Twenty-eighth Day of September, 2004

JON W. DUDAS
*Director of the United States Patent and Trademark Office*